US010752427B2

(12) United States Patent
Starzman et al.

(10) Patent No.: US 10,752,427 B2
(45) Date of Patent: Aug. 25, 2020

(54) CHILD RESISTANT AEROSOL ACTUATOR

(71) Applicant: WD-40 COMPANY, San Diego, CA (US)

(72) Inventors: Michael J. Starzman, Jackson, WI (US); John W. Freudenberg, Marysville, OH (US); Kevin Victor Bates, Northants (GB); Benjamin Thomas Krupp, Wyoming, OH (US); Robert Gerald States, III, Morrow, OH (US); David A. Parrott, Cincinnati, OH (US); Robert J. Good, Lee's Summit, MO (US); Joseph K. Dodd, Lee's Summit, MO (US); Sara Dawson Falcon, Richmond, VA (US)

(73) Assignee: WD-40 COMPANY, San Diego, CA (US)

( * ) Notice: Subject to any disclaimer, the term of this patent is extended or adjusted under 35 U.S.C. 154(b) by 75 days.

(21) Appl. No.: 16/229,914

(22) Filed: Dec. 21, 2018

(65) Prior Publication Data

US 2019/0119031 A1 Apr. 25, 2019

Related U.S. Application Data

(63) Continuation of application No. 15/701,558, filed on Sep. 12, 2017, now Pat. No. 10,370,176.

(51) Int. Cl.
*B65D 83/20* (2006.01)
*B65D 83/22* (2006.01)
(Continued)

(52) U.S. Cl.
CPC ..... *B65D 83/20* (2013.01); *B05B 1/1645* (2013.01); *B05B 11/3059* (2013.01);
(Continued)

(58) Field of Classification Search
CPC ..... B65D 83/20; B65D 50/046; B65D 83/24; B65D 83/22; B65D 83/30; B65D 2215/02; B05B 11/3059
See application file for complete search history.

(56) References Cited

U.S. PATENT DOCUMENTS

2007/0235474 A1* 10/2007 Downey ..... B65D 83/205 222/153.11
2007/0241134 A1* 10/2007 Gurrisi ..... B65D 83/384 222/153.11
(Continued)

*Primary Examiner* — Donnell A Long
(74) *Attorney, Agent, or Firm* — Epstein Drangel LLP; Robert L. Epstein

(57) ABSTRACT

The actuator includes a shroud adapted to be situated on an aerosol container over the stem and an actuation member mounted on and moveable within the shroud to depress the stem by the application of an external force applied to the top surface of the actuation member. The actuation member includes a nozzle and a conduit for connecting the stem and the nozzle. A hood is normally positioned to block the actuation member from being moved to depress the stem. A locking member normally intersects the path of movement of the hood to lock the hood in its blocking position. The locking member has two sections both of which must be simultaneously moved to a position remote from the path of hood movement such that the hood may be moved from its blocking position, allowing the actuation member to be moved to depress the stem.

30 Claims, 8 Drawing Sheets

(51) Int. Cl.

| | |
|---|---|
| ***B65D 83/24*** | (2006.01) |
| ***B65D 83/30*** | (2006.01) |
| ***B65D 50/04*** | (2006.01) |
| ***B05B 11/00*** | (2006.01) |
| ***B05B 1/16*** | (2006.01) |

(52) U.S. Cl.
CPC ..... *B65D 50/046* (2013.01); *B65D 83/22* (2013.01); *B65D 83/24* (2013.01); *B65D 83/30* (2013.01); *B65D 83/303* (2013.01); *B05B 11/0094* (2013.01); *B65D 2215/02* (2013.01)

(56) References Cited

U.S. PATENT DOCUMENTS

| | | | | |
|---|---|---|---|---|
| 2008/0164285 | A1* | 7/2008 | Hygema ..... | B65D 83/205 222/153.11 |
| 2010/0155427 | A1* | 6/2010 | Lilienthal ..... | B65D 83/205 222/182 |
| 2011/0006083 | A1* | 1/2011 | Walters ..... | B65D 83/206 222/153.11 |
| 2011/0220685 | A1* | 9/2011 | Lind ..... | B65D 83/206 222/402.11 |

* cited by examiner

CHILD RESISTANT AEROSOL ACTUATOR

CROSS-REFERENCE TO RELATED APPLICATIONS

This application is a continuation of copending application Ser. No. 15/701,558, filed Sep. 12, 2017, and claims priority thereon.

STATEMENT REGARDING FEDERALLY SPONSORED RESEARCH OR DEVELOPMENT

Not Applicable

REFERENCE TO A "SEQUENCE LISTING", A TABLE, OR A COMPUTER PROGRAM LISTING APPENDIX SUBMITTED ON COMPACT DISC

Not Applicable

BACKGROUND OF THE INVENTION

1. Field of the Invention

The present invention relates to aerosol actuators and more specifically to a child resistant aerosol actuator.

2. Description of Prior Art Including Information Disclosed Under 37 CFR 1.97 and 1.98

Child resistant closures for many types of containers are known in the art. In particular, such closures are required for use on containers for pharmaceutical products and have become increasing commonly used on other household products which are potentially dangerous if accidentally ingested by children.

Closures which are child resistant must have different structures and functions based upon the type of container the closure is designed to be used with. Closures commonly require two or more separate actions to open, for example certain caps or lids must be depressed and then rotated to be removed. To be user friendly, the function of such multiple action closures must be simple and obvious. At the same time, the child resistant structure must be unobtrusive, and not interfere with the normal use of the closure.

Further, child resistant closures designed for use with aerosol products provided in pressurized containers with depressible valve stems have special requirements because the closure mechanism has to include a means of applying a significant downward force on the valve stem to release the pressurized fluid from the container which can be easily manipulated by an adult but at the same time requires more strength and/or cognition than a child would normally be expected to possess. In that regard, conventional child resistant closures have employed flip-top caps, caps attached to rotatable collars, depressible/rotatable closures, and various types of crossbars, tabs or caps which must be moved or squeezed before a pushbutton can be depressed.

U.S. Pat. No. 6,854,619 disclosures a flip-top closure with child resistant packaging system. The flip-top closure includes a cap formed integral with a base member and connected to the base member by a hinge which facilitates pivoting motion of the cap relative to the base member. The child resistant locking system includes a releasable locking engagement which facilitates retaining the cap in a locked position and resists opening of the flip-top container by a child when the cap is in the closed position and upon squeezing opposed side walls of the cap inwardly in a squeeze direction to decrease a diameter of the cap and increase a diameter of the cap in a direction extending normal the squeeze direction to allow movement of the cap to the open position.

U.S. Pat. No. 7,222,754 relates to an aerosol system having lockable cap. A cap is removeably attached to a collar rotatably secured to the container. When the cap is rotated, the cap and collar rotate together about the rim of the container without detaching. The cap encloses an applicator or pump preventing inadvertent dispensing of the contents as well as rendering the container more tamper resistant. In one variation, the cap includes at least one tooth which engages a slot or an opening in the collar to achieve locking. The cap may be rotated or snap fit into place depending on the variation. Caps that are directly mountable to a rim of a container are also disclosed.

U.S. Pat. No. 8,777,061 involves a safety closure for container including a security cap and an applicator assembled within an interior of an upstanding wall which is longitudinally movably and axially rotatable enabling cycling between a locked state and an unlocked state. The applicator is rotationally governed by a rotation locking member including a push button and an arched biasing member. Vertical motion of a push button is governed by a projecting locking feature extending from the applicator. The locking feature engages with a actuation governing edge in a locked state and rotates free of the governing edge into an unlocked, dispensing state, enabling vertical motion of the applicator for dispensing contents from with the container.

U.S. Pat. No. 7,588,171 teaches an applicator for an aerosol container including a crossbar is disposed between the container and the applicator button. The crossbar is movable with respect to the valve stem between at least a first position blocking depression of the applicator button with respect to the valve stem and a second position permitting depression of the applicator button with respect to the valve stem. The crossbar can be moved from either side of the applicator, and one or more springs are carried by the crossbar for engaging the container and biasing the crossbar to the blocking position.

U.S. Pat. No. 6,691,896 is directed to a safety closure for a container which includes a sleeve fixed to the container inside of which a part is rotatable to place the container in a position where dispensing may take place. A recess in the sleeve with a vertical wall cooperates with an outwardly biased hinged tab on the rotatable part abutting the wall and preventing rotation, unless the tab is pushed in to clear the wall, while at the same time rotating the first part to said dispensing position.

However, none of the above structures provide a multiple action safety mechanism designed for use as an aerosol actuator which has the right balance of simple functionality, obviousness and unobtrusiveness.

BRIEF SUMMARY OF THE INVENTION

It is a prime object of the present invention to provide a child resistant aerosol actuator.

It is another object of the present invention to provide a child resistant aerosol actuator which has simple functionality.

It is another object of the present invention to provide a child resistant aerosol actuator the use of which is obvious to an adult.

It is another object of the present invention to provide a child resistant aerosol actuator which is unobtrusive.

It is another object of the present invention to provide a child resistant aerosol actuator which requires more strength and/or cognition to manipulate than a child would normally be expected to have.

It is another object of the present invention to provide a child resistant aerosol actuator which includes a pivotally mounted hood which must be moved to a particular position in order to depress a spring-loaded valve stem.

It is another object of the present invention to provide a child resistant aerosol actuator in which a locking part is normally positioned to prevent the movement of the hood.

It is another object of the present invention to provide a child resistant aerosol actuator in which the locking part can be moved to a position remote from the path of movement of the hood by the application of an external force.

It is another object of the present invention to provide a child resistant aerosol actuator in which the locking part includes two sections and wherein the application of force on both sections simultaneously is required to allow hood movement.

It is another object of the present invention to provide a child resistant aerosol actuator wherein the application of a substantially evenly distributed force across both sections of the locking part is required to allow hood movement.

It is another object of the present invention to provide a child resistant aerosol actuator in which the direction of the application of force on the locking part to allow hood movement is substantially orthogonal to the direction of the application of force necessary to depress the valve stem to release the contents of the aerosol container.

It is another object of the present invention to provide a child resistant aerosol actuator which includes a nozzle moveable to select a spray pattern wherein the valve stem cannot be depressed by movement of the nozzle.

It is another object of the present invention to provide a child resistant aerosol actuator which is formed of simple parts which function reliably together to achieve a long useful life.

It is another object of the present invention to provide a child resistant aerosol actuator which is formed of inexpensive injection molded parts which can be mass produced.

The above objects are achieved with the present invention which relates to a child resistant aerosol actuator for use with a container of pressurized fluid with a valve having a stem depressible to release the contents of the container. The actuator includes a shroud adapted to be situated on the container over the stem. An actuation member having a surface is mounted on the shroud for movement between as first position wherein the stem is not depressed and a second position wherein the stem is depressed by the application of an external force applied to the actuation member surface. The actuation member includes a nozzle and a conduit connecting the stem and the nozzle. A hood is normally positioned to prevent the actuation member from being moved from its first position to its second position. A locking part normally blocks the hood from being moved from its normal position. The locking part is moveable to a position wherein the hood may be moved to the position where the actuation member is no longer prevented from being moved to its second position by an external force applied to the actuation member surface.

The shroud is adapted to engage the container and surround the stem.

The nozzle includes an outlet port and is connected to the actuation member. A second outlet port is provided in the nozzle. The nozzle is pivotally mounted on the actuation member to select one of the two outlet ports. The outlet ports each produce different spray patterns.

The shroud has a recess. The actuation member includes an outwardly extending part adapted to extend into and move within the shroud recess. The part moves within the recess between a position wherein the actuation member can be moved to its second position to depress the stem and a position wherein the actuation member is prevented from being moved to its second position depress the stem.

The actuator includes a part extending from the hood. The hood part blocks the actuation member part from moving in the shroud recess to a position where the actuation member can be moved to depress the stem. In that position of the hood, the hood part prevents an external force applied to the actuation member surface from depressing the stem and also prevents the movement of the nozzle from accidentally depressing the stem.

The hood is moveable to a position wherein the hood part is remote from the shroud recess such that the hood part does not prevent the actuation member part from moving in the recess and the actuation member may be moved to its second position to depress the stem.

The locking part extends from the shroud to a position intersecting the path of movement of the hood such that the hood cannot be moved from its first position preventing the actuation member from depressing the stem.

The locking part normally engages the hood to prevent the hood from being moved from its position preventing the actuation member from depressing the stem.

The locking part can be moved by the application of external force on the locking part from its normal position intersecting the path of movement of the hood to a position out of the path of movement of the hood.

The locking part includes two sections both of which must be moved out of the path of hood movement at the same time to allow the hood to be moved from its position preventing the actuation member from depressing the stem. A substantially evenly distributed external force must be applied across both sections of the locking part in order to move the locking part out of the path of hood movement.

In accordance with another aspect to the present invention, a child resistant aerosol actuator is provided for use with a container of pressurized fluid having a top portion with a stem valve associated with a spring. The spring normally urges the stem toward an extended position to close the valve. The stem can be moved to a depressed position against the urging of the spring to open the valve and release the contents of the container. The actuator includes a shroud adapted to be situated over the top portion of the container surrounding the stem. An actuation member has a surface aligned with the stem and is mounted on the shroud for movement relative to the shroud between a first position wherein the stem is extended and a second position wherein the stem is depressed by the application of an external force on the actuation member surface. The actuation member includes a nozzle and a conduit connecting the stem and the nozzle. A hood is mounted on the shroud for pivotal movement between a blocking position wherein movement of the actuation member to its second position to depress the stem is prevented and an unblocking position wherein movement of the actuation member to it second position to depress the stem is not prevented. A locking part normally situated to prevent the hood from being moved toward its unblocked position is provided. The locking part is moveable to a position wherein the hood may be moved towards its unblocking position.

The shroud is adapted to engage the top portion of the container and surround the stem.

The nozzle is attached to the actuation member and includes an outlet port. A second outlet port is situated in the nozzle. The nozzle is pivotally connected to the actuation member. The outlet ports each produce different spray patterns.

The shroud has a recess. The actuation member includes an outwardly extending part adapted to extend into and move within the shroud recess between a position wherein the actuation member can be moved to its second position to depress the stem by an external force applied to the actuation member surface and a position wherein the actuation member is prevented from being moved from its first position to depress the stem.

A part extends from the hood. The hood part blocks the actuation member part from moving in the shroud recess to a position where the actuation member can be moved to depress the stem.

The hood is moveable to a position wherein the hood part is remote from the shroud recess such that it does not prevent the actuation member part from being moved in the shroud recess and the actuation member may be moved to depress the stem.

The locking part extends from the shroud to a position intersecting the path of movement of the hood such that the hood cannot be moved from its normal position preventing the actuation member from depressing the stem.

The locking part is adapted to engage the hood to prevent the hood from being moved from its normal position.

The locking part can be moved by the application of external force on the locking part from its normal position intersecting the path of movement of the hood to a position out of the path of movement of the hood.

The locking part includes two sections both of which must be moved out of the path of hood movement at the same time to allow the hood to be moved from its position preventing the actuation member from depressing the stem. A substantially evenly distributed external force must be applied across both sections of the locking part in order to move the locking part out of the path of hood movement.

In accordance with another aspect of the present invention, a child resistant aerosol actuator is provided for use with a container of pressurized fluid with a valve having a stem depressible to release the contents of the container. The actuator includes a first part adapted to be situated on the container over the stem and a second part mounted on the first part for movement relative to the first part between a first position wherein said second part does not depress the stem and a second position wherein application of an external force applied to the part surface depresses the stem. The second part has a nozzle and a conduit for connecting the stem and the nozzle. A third part is normally positioned to prevent the second part from depressing the stem. A fourth part is normally positioned to intersect the path of movement of the third part to prevent the third part from being moved from its normal position. The fourth part is moveable to a position remote from the path of movement of the third part such that the third part may be moved to its second position by the application of an external force applied to the second part surface.

The fourth part includes first and second sections. Both of the first and second sections of the fourth part must be depressed at the same time to allow the third part to be moved to a position wherein the second part may be moved to depress the stem. A substantially evenly distributed force must be exerted across both of the first and second sections of the fourth part to permit the third part to be moved to a position wherein the second part may be moved to depress the stem.

The second part is moveable to depress the stem by exerting a force in a first direction. The fourth part is moved to a position remote from the path of movement of the third part by exerting a force in a second direction. The first direction and the second direction are different directions. Preferably, the first direction and the second direction are substantially orthogonal directions.

BRIEF DESCRIPTION OF THE SEVERAL VIEWS OF DRAWINGS

To these and to such other objects that may hereinafter appear, the present invention relates to a child resistant aerosol actuator as described in detail in the following specification and recited in the annexed claims, taken together with the accompanying drawings, in which like numerals refer to like parts and in which:

DETAILED DESCRIPTION OF THE INVENTION

Figure 1:
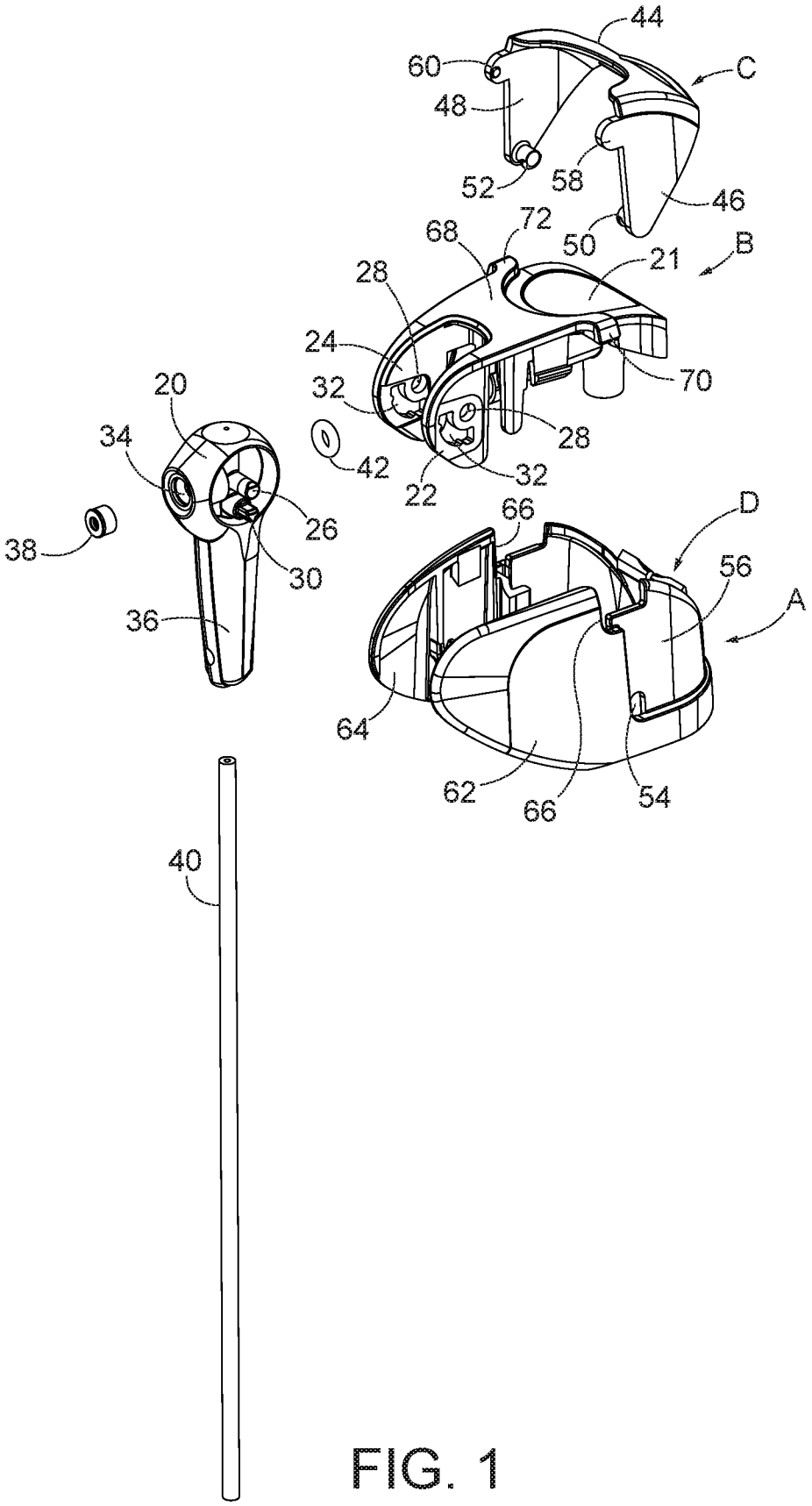
FIG. 1 is an exploded perspective view of the parts of the actuator of the present invention.
Figure 2:
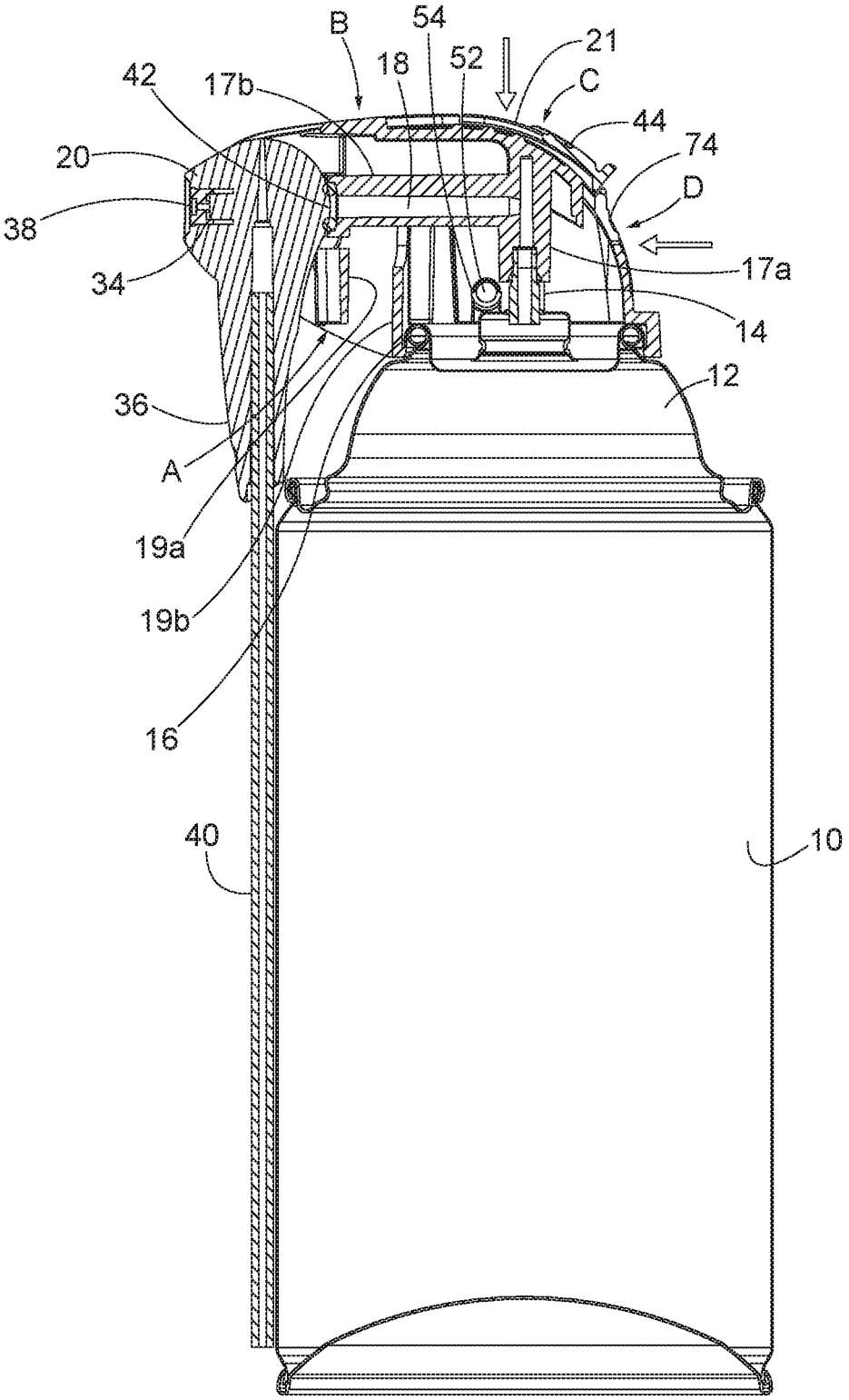
FIG. 2 is a side cross-sectional view of the assembled actuator showing the parts in the locked position.

The actuator of the present invention includes four main parts, three of which are shown in FIG. 1. The first part, generally designated A, is a shroud which is adapted to be attached to the top of an aerosol container over the valve stem, as shown in FIG. 2.

The second part, generally designated B, is an actuation member which is moveably mounted within shroud A for movement relative to the shroud between a first position wherein the stem is not depressed and a second position wherein the stem is depressed by the application of an external force on a surface of the first part which is aligned with the stem. The second part includes a nozzle at the front end with at least one outlet port. The body of actuation member B includes a conduit connecting the stem and the nozzle. When the pressurized fluid contents of the container are released from the depressed stem, the contents pass through the conduit to the nozzle. From the nozzle, the fluid exits the outlet port in a spray pattern determined by the size and shape of the outlet port.

The third part, generally designated C, is a hood which is pivotally mounted on shroud A. Hood C is mounted for movement between a first, blocking position in which hood C prevents actuation member B from depressing the stem and a second, unblocking position in which hood C does not prevent actuation member B from being moved to depress the stem.

Figure 5:
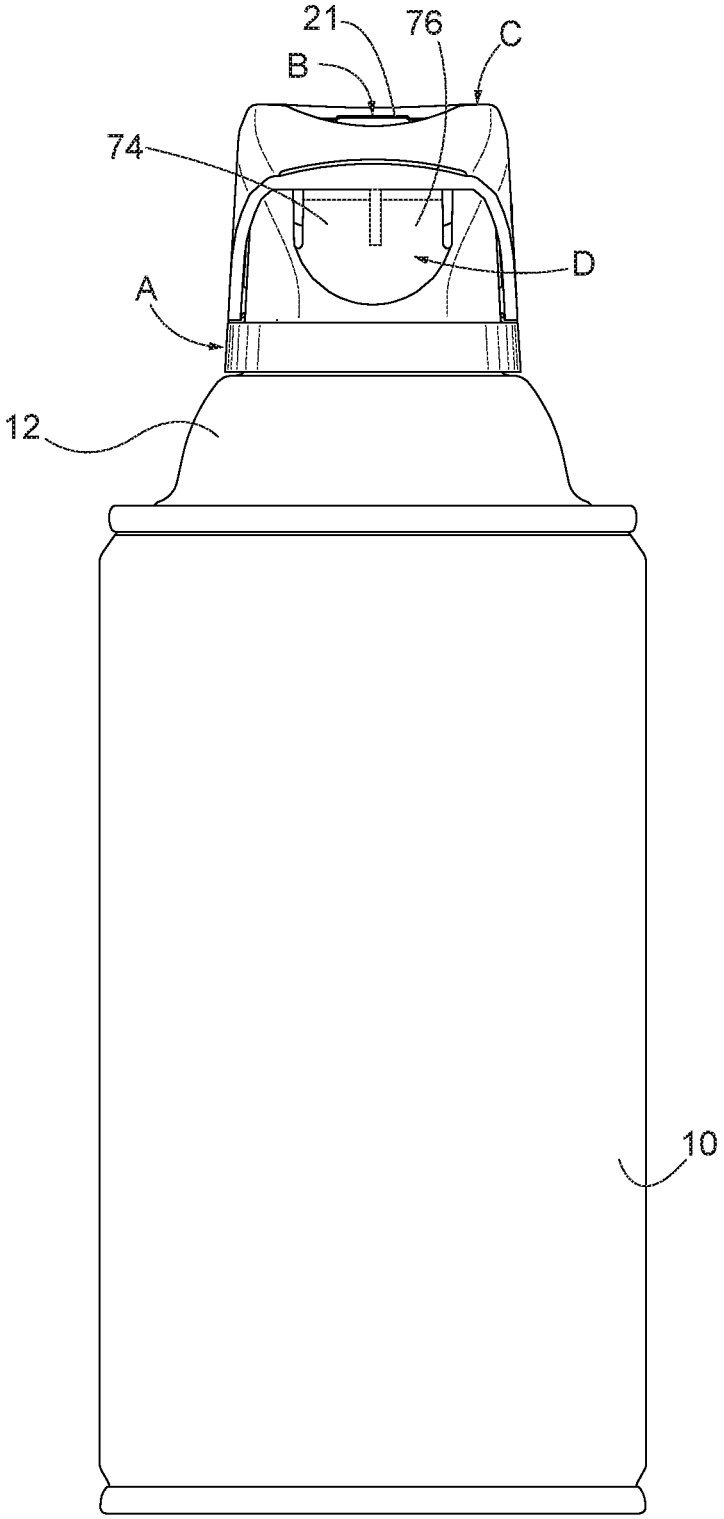
FIG. 5 is a rear elevation view of the actuator with the hood in the locked position.

The fourth part, generally designated D, is a locking member, best seen in FIG. 5. Locking member D extends from the rear portion of shroud A such that the unattached end of the locking member is normally positioned to intersect the path of movement of hood C (see FIG. 2) such that it prevents hood C from being moved from its first blocking position in which it prevents actuation member B be from depressing the stem.

The application of an external force on locking member D, in a direction generally toward the stem and orthogonal to the direction of stem movement, will cause the unattached end of locking member D to move to a location which is remote from the path of movement of hood D. In that position of locking member D, hood C can be moved to its second, unblocking position such that the actuation member B can be moved to depress the stem. With the hood in the second, unblocking position, an external downwardly directed force applied to the top surface of actuation member B, in a direction generally parallel to the direction of stem movement, will cause the stem to depress and open the container valve to allow the fluid contents of the container to exit the container.

Figure 7:
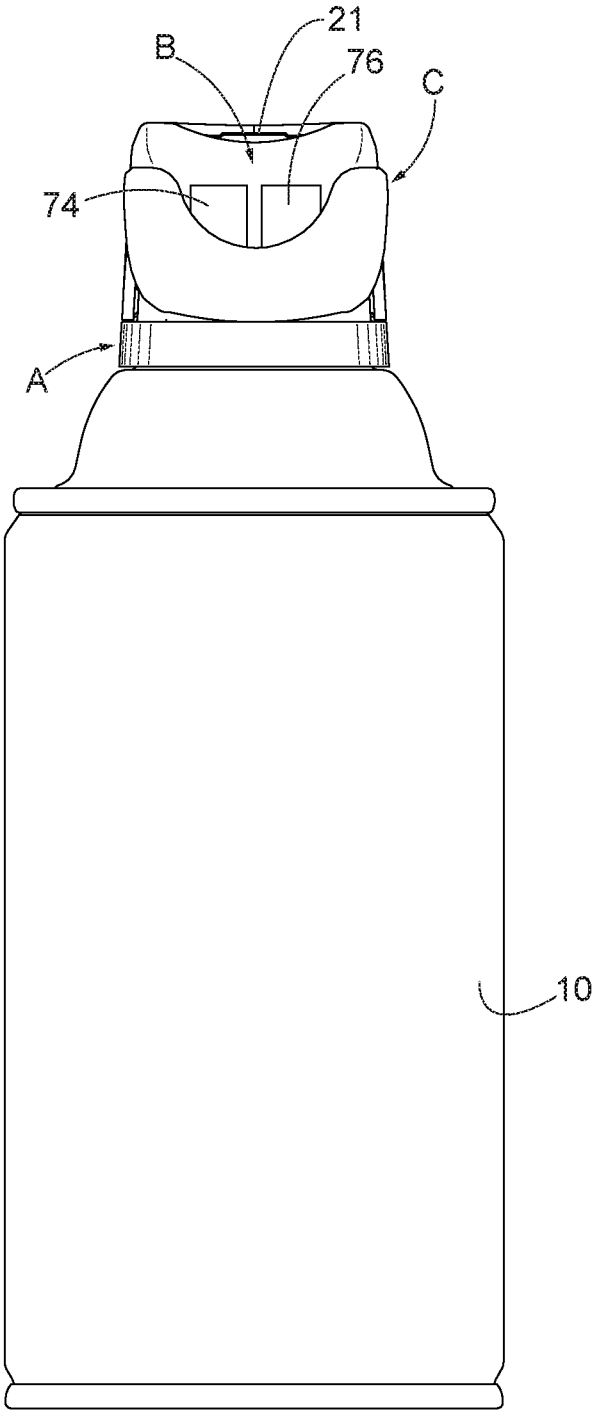
FIG. 7 is a rear elevation view of the actuator with the hood in the unlocked position.
Figure 8:
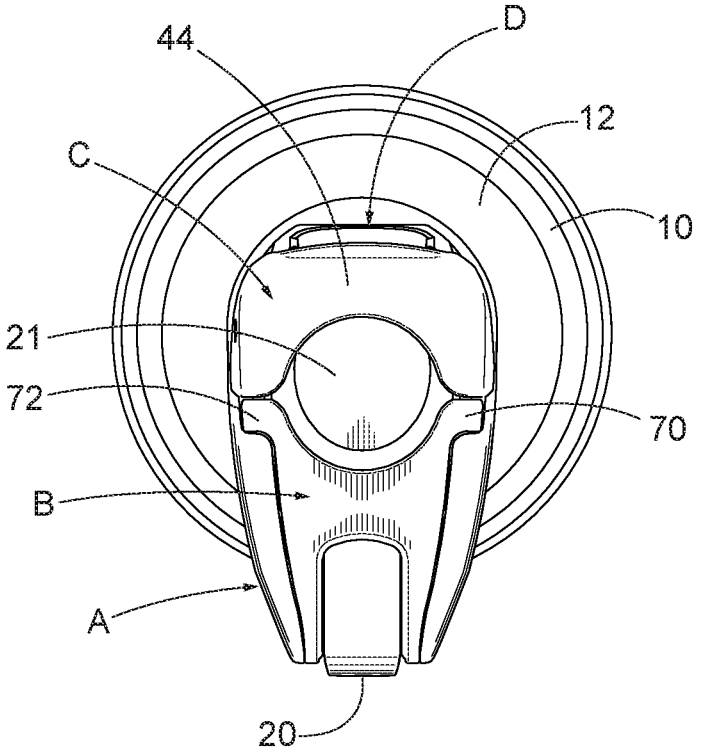
FIG. 8 is a top plan view of the actuator showing the hood in the locked position.
Figure 9:
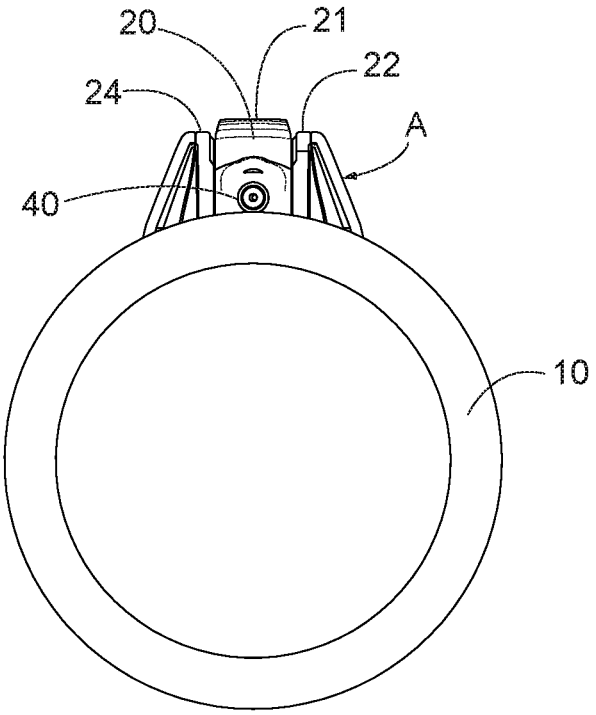
FIG. 9 is a bottom plan view of the aerosol container with the actuator mounted thereon.

FIGS. 5 and 7 show the locking member in its locked position intersecting the path of movement of hood C and in its unlocked position remote from the path of movement of hood C, respectively. The locking member is fabricated of resilient plastic such that it can flex such that the unattached end can move when an external force is applied to the locking member in a direction generally orthogonal to the direction of stem movement.

From those figures it can be seen that locking member D is bifurcated into first and second sections. In order to move the locking member to its unlocked position remote from the path of movement of hood C, both of the first and second sections of the locking member must be depressed at the same time. More particularly, a substantially evenly distributed force must be applied across both of the first and second sections of the locking member to move the unattached end of the locking member to a position remote from the path of movement of the hood to permit the hood to be moved from its first blocking position toward its second unblocking position where the actuation member B can be moved to depress the stem to release the container contents.

The direction of the external force applied to the locking member to release the hood is different than the direction of the external force applied to the actuation member surface to depress the stem. Specifically, those directions are substantially orthogonal.

Accordingly, to release the container contents, three separate actions must be performed. First, the locking member must be moved to its unlocked position by the application of substantially evenly distributed force across both of the first and second sections of the locking member. Second, the hood must be moved from its first, blocking position toward its second, unblocking position. Third, the actuation member must be moved toward the container by application of a downwardly directed external force applied to the top surface of the actuation member to depress the stem to release the pressurized fluid.

Referring now to FIG. 2, the actuator of the present invention is designed for use with a container 10 of pressurized fluid. Container 10 has a top portion 12 with an internal valve (not shown) which is actuated by depressing a spring-loaded stem 14. The spring (not shown) associated with stem 14 normally urges the stem upwardly toward an extended position at which the valve is closed. The stem can be moved downwardly to a depressed position, against the urging of the spring, to open the valve and release the contents of the container through the stem.

The top portion of the container includes a circular lip 16. The edge of the lower portion of shroud A is formed to engage lip 16 in a "snap-fit" manner to mount the actuator on the top portion 12 of the container surrounding the stem 14.

Shroud A is hollow and includes vertically extending structural members 19*a* and 19*b* which have openings through which actuation member B extends. The openings are large enough to allow limited movement of the actuation member between an upper position, as seen in FIG. 2, wherein stem 14 is not depressed, and a lower position, wherein the stem is depressed.

Actuation member B has an internal part 17 which includes a vertical portion 17*a* situated to engage stem 14. A downwardly directed external force applied to the upper surface 21 of the actuation member will cause vertical portion 17*a* of the actuation member to depress stem 14 to release the contents of the container. Stem 14 is spring-loaded such that when the external force applied on the top surface 21 of the actuation member is released, the spring will automatically move the stem to its non-depressed position, closing the valve, and the actuation member back to its upper position.

Portion 17*a* is hollow and defines the vertical section of a conduit 18 which guides the fluid released from the stem to a nozzle 20. The other section of conduit 18 is defined by hollow portion 17*b* which extends horizontally from portion 17*a* to nozzle 20.

Nozzle 20 is rotatably mounted between the spaced forward sections 22 and 24 of actuation member B, see FIG. 1. In particular, nozzle 20 has outwardly directed axle members 26 at each side which are adapted to be received within round recesses 28 in sections 22 and 24 of actuation member B. Nozzle 20 also has outwardly extending rectangular stop members 30 adapted to be received in arcuate channels 32 in each of the actuation member sections 22 and 24 to limit the movement of the nozzle relative to the actuation member.

Nozzle 20 has two outlet ports 34 and 36 which are directed at right angles to each other. Port 34 is adapted to receive a spray pattern defining member 38. Member 38 causes the fluid released from the container to exit in a wide spray pattern when the nozzle is in the position illustrated in FIG. 2 such that port 34 is connected to conduit 18. In that position of the nozzle, there is no fluid connection between conduit 18 and port 36 and fluid from the container cannot exit through port 36.

Port 36 is elongated and adapted to receive the end of a flexible tube 40. Tube 40 can be configured as necessary to direct the fluid to a specific target without depositing in areas where it is not needed. When the nozzle is in the position shown in FIG. 6, fluid from conduit 18 travels through port 36 into tube 40 and exits through the unattached end of tube 40 in a narrow spray pattern. Accordingly, the pattern in which the released fluid is sprayed is determined by the rotational position of the nozzle. A rubber sealing ring 42 is situated between the end of conduit 18 and nozzle 20 to prevent leakage.

Figure 6:
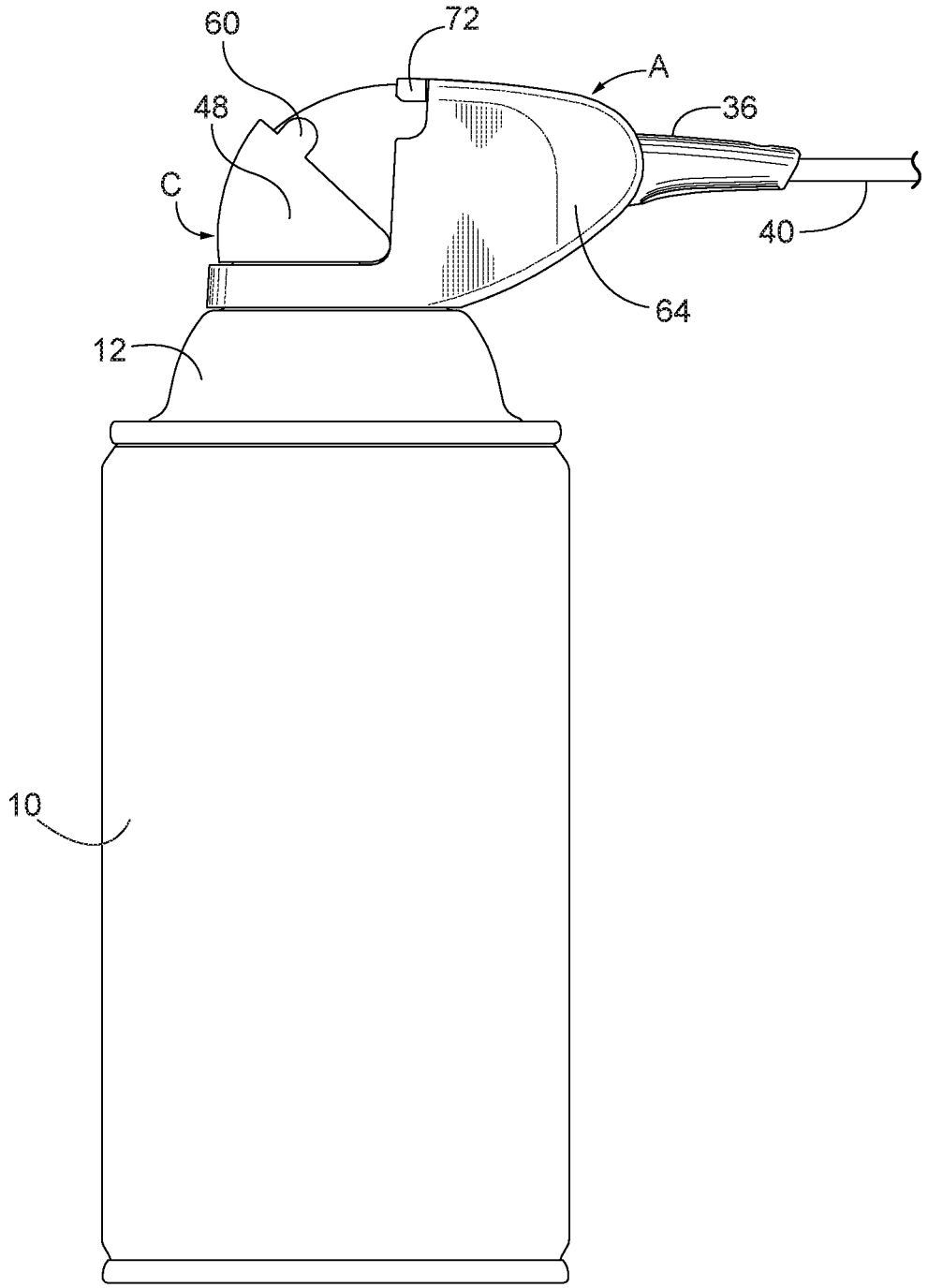
FIG. 6 is a side elevation view of the actuator with the hood in the unlocked position and the nozzle in the narrow spray pattern position.

Referring again to FIG. 1, hood C includes a top surface 44 and spaced side portions 46 and 48. Protruding inwardly from each of the interior surfaces of side portions 46 and 48 are axle protrusions 50, 52, respectively. Protrusions 50, 52 are adapted to be received in openings 54 in shroud C such that hood C can rotate between its first blocking position (FIG. 4) and its second unblocking position (FIG. 6).

It should be noted that the upper rear portion 56 of shroud A, extending between axle receiving openings 54, is recessed relative to the remained of the exterior of the shroud by a distance approximately equal to the thickness of hood C. Accordingly, the exterior surface of the hood is substantially co-extensive with the exterior surface of the remainder of the shroud.

Figure 4:
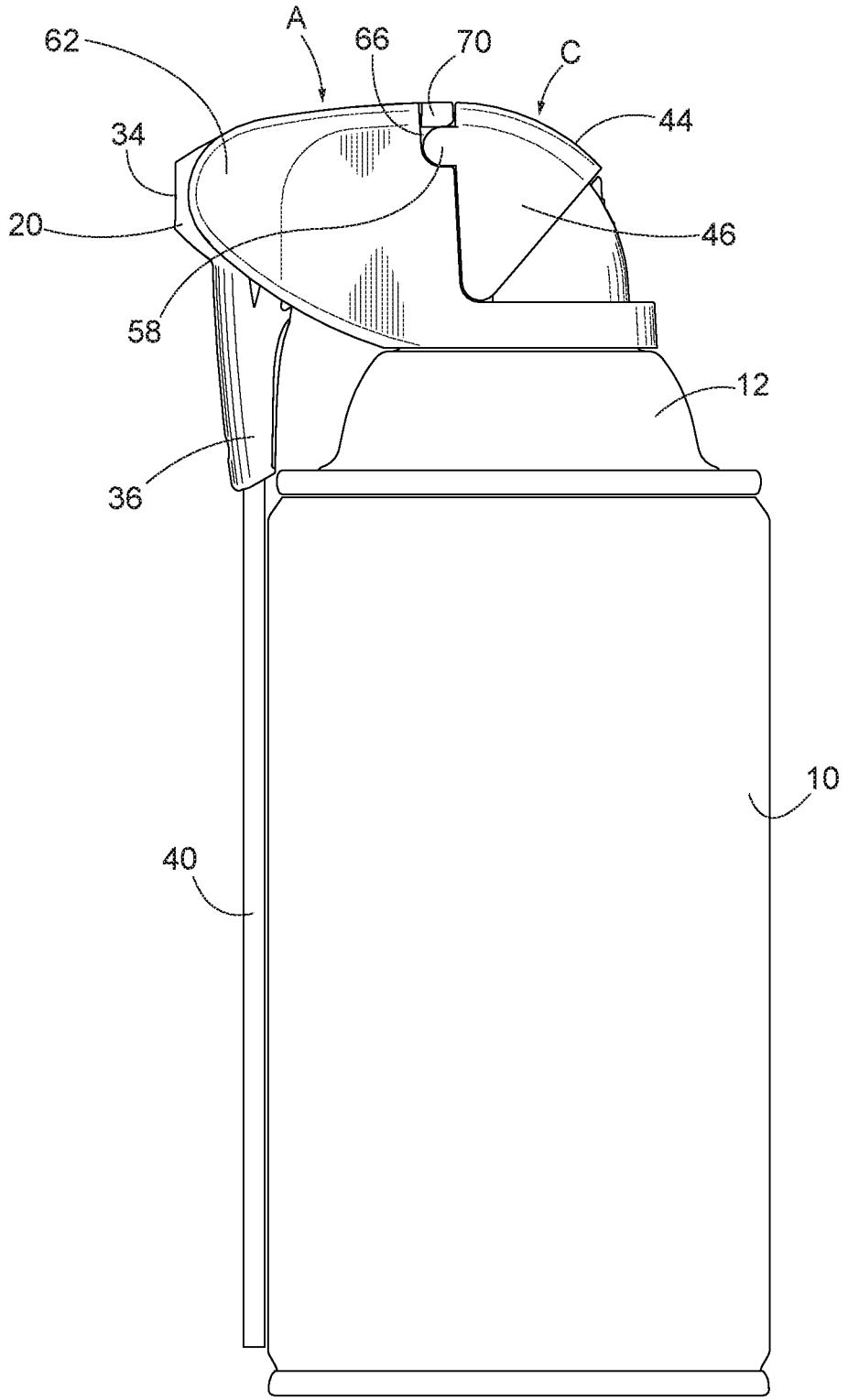
FIG. 4 is a side elevation view of the actuator showing the hood in the locked position.

The sides 46, 48 of the hood each have a forwardly extending rounded protrusion 58, 60, respectively. Each of the sides 62, 64 of the shroud have a recess or indentation 66 in the upper rear corner of the side, as best seen in FIG. 4. Protrusions 58, 60 are situated on the hood such that they can extend into recesses 66 when the hood is in the first, blocking position.

The top surface 68 of actuation member B has outwardly extending rectangular shaped protrusions 70, 72. Protrusions 70, 72 also extend into recesses 66. Protrusions 70, 72 move up and down within recesses 66 as the actuation member moves within the shroud between its position in which stem 14 is not depressed and its position in which the stem is depressed.

When the hood is in its first, blocking position, protrusions 58, 60 of the hood are situated beneath protrusions 70, 72 of the actuation member in recesses 66. In that position of the hood, the hood protrusions block the actuation member protrusions from moving downwardly in the recesses. That in turn prevents the actuation member from being moved toward the container to depress the stem and release the contents of the container.

As noted previously, nozzle 20 is rotatably mounted on the front end of the actuation member. The application of an external force on the nozzle, rotating the nozzle to a position where elongated port 36 is above its horizontal spray position perpendicular to the container (FIG. 6), would normally cause the actuation member to depress the valve stem resulting in an accidental release of fluid. However, the accidental release of fluid in such circumstance is prevented by the hood in its blocking position, because protrusions 58, 60 of the hood prevent protrusions 70, 72 of the actuation member from moving downward within recesses 66.

Once the hood is moved to its second unblocking position, shown in FIG. 6, the hood protrusions 58, 60 are no longer situated in recesses 66. Thus, the actuation member B protrusions 70, 72 are no longer prevented from moving down within recesses 66 toward the container. In that position, the hood does not prevent the application of an external force on the on surface 68 of the actuation member from moving the actuation member toward the container to depress the stem and release the contents of the container.

Hood protrusions 58, 60 are rounded. The arcuate surfaces of the protrusions serve to cam the actuation member protrusions upwardly out of the way of the hood protrusions as the hood is moved from its second, unblocking position toward its first, blocking position such that the hood protrusions can be received beneath the actuation member protrusions in order to prevent an external downward force on the actuation member from causing the actuation member to depress the stem.

Figure 3:
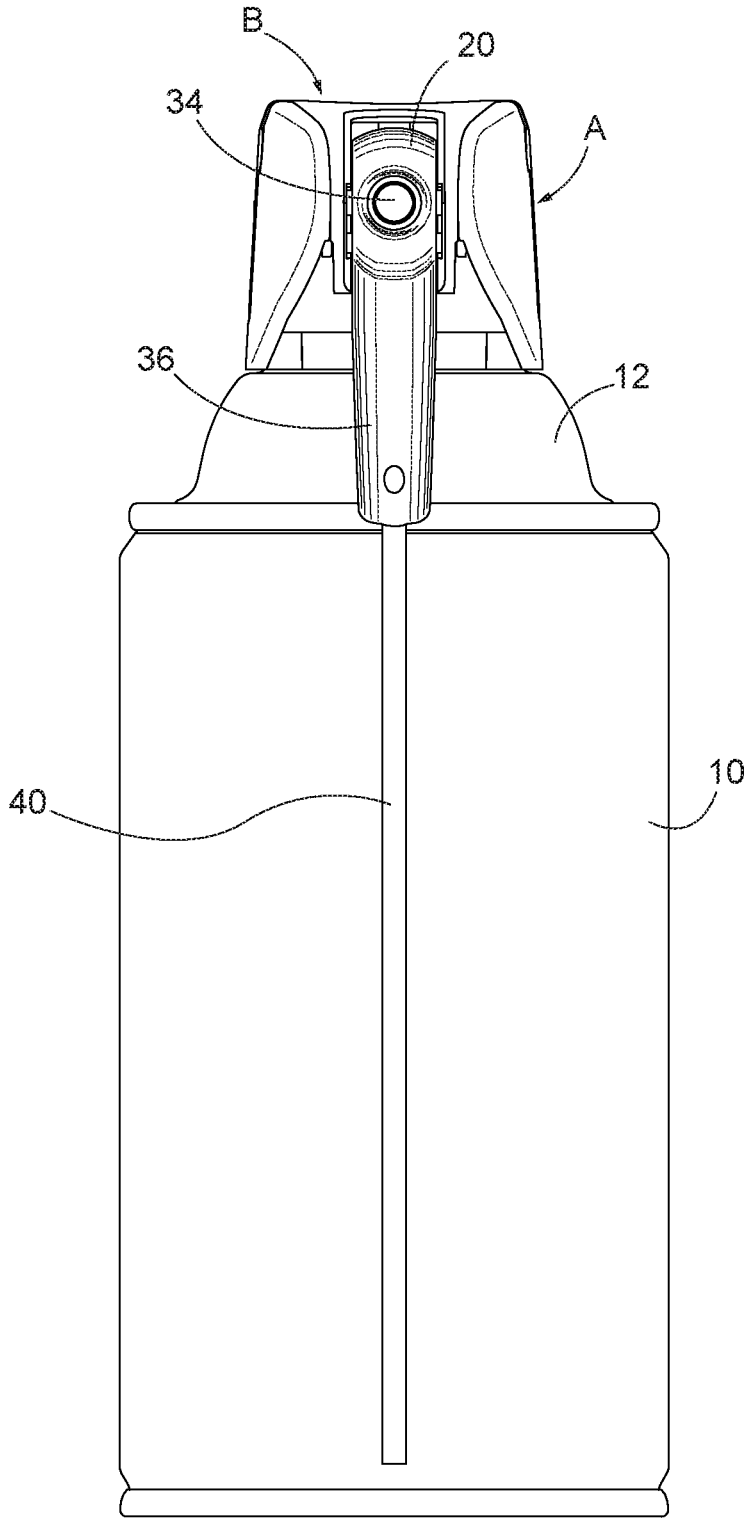
FIG. 3 is a front elevation view of the actuator with the nozzle in the wide spray pattern position.

The rubber sealing ring 42 creates a fluid tight connection between the end of conduit 18 of the actuation member and the nozzle 20. As a result, there is substantial amount of friction between the nozzle surface and the sealing ring as the nozzle is moved from its vertical position adjacent the container, as seen in FIGS. 2, 3 and 4, toward its horizontal position perpendicular to the container, as seen in FIG. 6. That friction tends to cause a downward force on the actuation member which would cause the actuation member to depress the stem, accidentally releasing fluid from the container as the nozzle is moved.

However, accidental depression of the actuation member caused by nozzle movement is also prevented by the hood, when the hood is in its first, blocking position. That is because, in its first, blocking position of the hood, hood protrusions 58. 60 are lodged beneath the actuation member protrusions 70, 72, respectively, such that the actuation member cannot be moved to depress the stem.

The hood cannot move from its first, blocking position toward its second, unblocking position until the locking member D is released by moving the unattached end of the locking member D out of the path of movement of the hood. Locking member D is flexible and the unattached end of the locking member can be moved out of the path of hood movement by the application of an external force in a direction which is substantially orthogonal to the direction of the force which must be applied to the actuation member to depress the stem, see the arrows in FIG. 2.

Locking member D has two coplanar spaced sections 74, 76. Both sections of the locking member must be simultaneously depressed such that the unattached ends thereof move from their position intersecting the path of hood movement, inwardly of the hood (FIGS. 2 and 5), to a position remote from the hood path (FIG. 7), thereby allowing the hood C to move away from its first, blocking position. A substantially evenly distributed force must be applied across both of the sections 74, 76 of the locking member to cause the unattached ends of the locking member sections to move to a position remote from the path of movement of the hood and thus to permit the hood to be moved from its first, blocking position such that the actuation member B can be moved to depress the stem to release the contents of the container.

The actuation member also acts as a stop, limiting the distance which the unattached ends of the sections of the locking member can be pushed toward the interior of the shroud. As is best seen in FIG. 2, the rear portion of the actuation member has a vertically extending wall which is aligned with but normally spaced a short distance from the unattached ends of the locking member sections. When the locking member sections are simultaneously depressed to clear the path of movement of the shroud toward its unblocking position, the rear wall of the actuation member limits the distance that the unattached ends of the sections can move, protecting the locking member sections from being damaged.

While only a single preferred embodiment of the present invention has been disclosed for purposes of illustration, it is obvious that many modifications and variations could be made thereto. It is intended to cover all of those modifications and variations which fall within the scope of the present invention, as defined by the following claims:

We claim:

1. An aerosol actuator for use with a container of pressurized fluid of the type having a valve with a stem depressible to release the contents of the container, said actuator comprising a shroud adapted to be situated on the container over the stem, an actuation member having a surface and being mounted for movement relative to said shroud between a first position wherein the stem is not depressed and a second position wherein the stem is depressed by the application of an external force applied to said actuation member surface, said actuation member including a nozzle and a conduit connecting the stem and said nozzle, a hood mounted for movement about an axis passing through said shroud comprising a part normally positioned under a portion of said actuation member to prevent said actuation member from being moved from said first position to said second position, and a locking member normally preventing said hood from being moved from its normal position, said locking member being moveable to a position wherein said actuation member is no longer prevented from being moved to said second position by an external force applied to said actuation member surface.

2. The actuator of claim 1 wherein said hood comprises a side portion and wherein said hood part extends from said side portion of said hood.

3. The actuator of claim 1 wherein said portion of said actuator member extends in a direction substantially perpendicular to the direction of movement of said actuation member.

4. An aerosol actuator for use with a container of pressurized fluid of the type having a valve with a stern depressible to release the contents of the container, said actuator comprising a shroud adapted to be situated, on the container over the stem, an actuation member having a surface and being mounted for movement relative to said shroud between ,a first position wherein the stem is not depressed and a second position wherein the stern is depressed by the application of an external force applied to said actuation member surface, said actuation member including a nozzle and a conduit connecting the stern and said nozzle, a hood moveable between a first position, wherein said actuation member is prevented from being moved from its first position to its second position, and a second position, wherein said actuation member is no longer prevented from moving from its first position to its second position, and .a locking member normally preventing said hood from being moved from its first position, said locking member being moveable to a position wherein said actuation member is no longer prevented from being moved to said second position by an external force applied to said actuation member surface, wherein said hood at least partially covers said locking member when said hood is in its second position.

5. The actuator of claim 4 wherein said hood is mounted on said shroud for rotation about an axis extending through said shroud substantially perpendicular to the direction of movement of said actuation member.

6. The actuator of claim 4 wherein said locking member comprises a deflectable portion and wherein said hood can be moved to its second position when said deflectable portion of said locking member is deflected.

7. An aerosol actuator for use with a container of pressurized fluid of the type having a valve with a stem depressible to release contents of the container, the actuator comprising; an actuation member configured to move between a non dispensing position in which the stem is not depressed and a dispensing position in which the stem is depressible by a user; a press-and-pivot safety mechanism to control movement of the actuation member, the press-and-pivot safety mechanism including;

a hood manually moveable between a blocking position in which the actuation member is blocked from being moved to the dispensing position and a non-blocking position in which the actuation member is free to be moved to the dispensing position; and a deflectable locking member to allow the hood to move from the blocking position to the non-blocking position, wherein, in use, to allow the actuation member to move into the dispensing position, the locking member is pressed until the hood is able to slide over the locking member as the hood is moved from the blocking position to the non-blocking position.

8. The aerosol actuator of claim 7 further comprising a shroud adapted to connect with the container, the locking member and the shroud being formed as a one piece construction.

9. The aerosol actuator of claim 7 wherein the hood is substantially "U" shaped and mounted on said shroud.

10. The aerosol actuator of claim 7 wherein the locking member includes two sections that must be simultaneously depressed to move the locking member to the non-blocking position.

11. The aerosol actuator of claim 7 wherein the hood includes at least one protrusion that is situated beneath at least one protrusion of the actuation member when the actuation member is in the non-dispensing position.

12. The aerosol actuator of claim 7 wherein said locking member is flexible and can be moved by the application of external force to allow the hood to be moved.

13. The aerosol actuator of claim 7 further comprising a shroud adapted to connect with the container, the locking member and the shroud being formed as a one-piece construction, wherein:

the hood covers a portion of the shroud when the hood is in the non-blocking position, the hood is substantially "U" shaped and mounted on said shroud, the locking member includes two sections that must be simultaneously depressed to move the locking member to the non-blocking position, the hood includes at least one protrusion that is situated beneath at least one protrusion of the actuation member when the actuation member is in the non-dispensing position, and said locking member is flexible and can be moved by the application of external force to allow the hood to be moved.

14. An actuator for use with a container of pressurized fluid of the type having a valve with a stem depressible to release the contents of the container, said actuator comprising:

a shroud adapted to be situated on the container over the stem;

an actuation member being mounted for movement relative to said shroud between a non-dispensing position wherein the stein is not depressed and a dispensing position, said actuation member including a nozzle and a conduit connecting the stem and said nozzle;

a manually moveable hood normally positionable in a blocking position in which a hood part is positioned under a portion of said actuation member to block said actuation member from being moved to said dispensing position; and a locking member normally preventing said hood from being moved from the blocking position, said locking member being manually depressable to a release position that allows the hood part to move from under the portion of the actuation member and allows said actuation member to be moved to said dispensing position.

15. The actuator of claim 14 wherein said hood comprises a side portion and wherein said hood part extends from said side portion of said hood.

16. The actuator of claim 14 wherein said portion of said actuator member extends in a direction substantially perpendicular to the direction of movement of said actuation member.

17. The actuator of claim 14 wherein said hood is mounted on said shroud for rotation about an axis extending through said shroud substantially perpendicular to the direction of movement of said actuation member.

18. The actuator of claim 14 wherein said locking member comprises a deflectable portion, and wherein said hood can be moved from the blocking position when said deflectable portion of said locking member is deflected.

19. An actuator for use with a container of pressurized fluid of the type having a valve with a stem depressible to release the contents of the container, said actuator comprising;

a shroud adapted to be situated on the container over the stem;

an actuation member being mounted for movement relative to said shroud between a non-dispensing position wherein the stem is not depressed and a dispensing positon, said actuation member including a nozzle and a conduit connecting the stem and said nozzle;

a hood normally positionable in a blocking position in which a hood part is positioned under a portion of said actuation member to block said actuation member from being moved to said dispensing position; and a locking member normally preventing said hood from being moved from the blocking position, said locking member being manually depressable to a release position that allows the hood part to move from under the portion of the actuation member and allows said actuation member to be moved to said dispensing position wherein the hood has an inner surface and an outer surface, the locking member has an outer surface, and the shroud has an outer surface on which the locking member is mounted, the inner surface of the hood being adapted to slide over the locking member and at least partly cover the outer surface of the shroud when the outer surface of the locking member is depressed to move the locking member to the release position.

20. The actuator of claim 19 wherein the inner surface of the hood and the outer surface of the shroud that slide over one another are curved as seen in side view.

21. An aerosol actuator for use with a container of pressurized fluid of the type having a valve with a stem depressible to release the contents of the container, said actuator comprising a shroud adapted to be situated on the container over the stern, an actuation member having a surface and being mounted for movement relative to said shroud between a first position wherein the stem is not depressed and a second position wherein the stem is depressed by the application of an external force applied to said actuation member surface, said actuation member including a nozzle and a conduit connecting the stern and said nozzle, a hood comprising a hood part normally positioned under a portion of said actuation member to prevent said actuation member from being moved from said first position to said second position, and a locking member normally preventing said hood from being moved from its normal position, said locking member being deflectable to a release position that allows the hood to slide over the locking member, such that the hood part moves from under the actuation member, wherein said actuation member is no longer prevented from being moved to said second position by an external force applied to said actuation member surface.

22. The actuator of claim 21 wherein the hood part includes a pair of hood parts normally positioned under portions of the actuation member, the pair of hood parts being positioned on opposite lateral sides of the surface of the actuation member.

23. The actuator of claim 21 wherein, when the hood part is positioned under the portion of the actuation, member, a portion of the surface of the actuation member is exposed.

24. The actuator of claim 21 wherein, when the locking member is deflected to the release position, the hood member is subsequently manually pivotable in a downward direction to move the hood part from under the portion of the actuation member.

25. The actuator of claim 21 wherein the locking member is formed in one piece with the shroud.

26. An aerosol actuator for use with a container of pressurized fluid of the type having a valve with a stern depressible to release contents of the container, the actuator comprising: an actuation member configured to move between a non-dispensing position in which the stem is not depressed and, a dispensing position in which the stem is depressible by a user; a press-and-pivot safety mechanism to control movement of the actuation member, the press-and-pivot safety mechanism including: a hood pivotable between a blocking position in which the actuation member is blocked from being moved to the dispensing position and a non-blocking position in which the actuation member is free to be moved to the dispensing position; and a deflectable locking member to allow the hood to move from the blocking position to the non-blocking position, wherein, in use, to allow the actuation member to move into the dispensing position, the locking member is pressed until the hood is able to downwardly slide over the locking member as the hood downwardly pivots from the blocking position to the non-blocking position.

27. An actuator for use with a container of pressurized fluid of the type having a valve with a stem depressible to release the contents of the container, said actuator comprising: a shroud adapted to be situated on the container over the stern; an actuation member being mounted for movement relative to said shroud between a non-dispensing position wherein the stern is not depressed and a dispensing position, said actuation member including a nozzle and a conduit connecting the stern and said nozzle; a hood normally positionable in a blocking position in which ,a hood part is positioned under a portion of said actuation member to block said actuation member from being moved to said dispensing position: and a locking member normally preventing said hood from being moved from the blocking position, said locking member being manually depressable to a release position that allows the hood part to move from under the portion of the actuation member and allows said actuation member to be moved to said dispensing position; wherein, in use, upon manually depressing the locking member, the hood is pivotably mounted to the shroud so as to slide over tine locking member and cover a lower portion of the shroud below the locking member.

28. The actuator of claim 27 wherein said hood comprises a side portion and wherein said hood, part extends from said side portion of said hood.

29. The actuator of claim 27 wherein said portion of said actuation member extends in a direction substantially perpendicular to the direction of movement of said actuation member.

30. An actuator for use with a container of pressurized fluid of the type having a valve with a stem depressible to release the contents of the container, said actuator comprising:

a shroud adapted to be situated on the container over the stem;

an actuation member being mounted for movement relative to said shroud between a non-dispensing position wherein the stem is not depressed and a dispensing position, said actuation member including a nozzle and a conduit connecting the stem and said nozzle;

a hood normally positionable in a blocking position in which a hood part is positioned under a portion of said actuation member to block said actuation member from being moved to said dispensing positon; and a locking member normally preventing said hood from being moved from the blocking position, said locking member being manually depressable to a release position that allows the hood part to move from under the portion of the actuation member and allows said actuation member to be moved to said dispensing position wherein, in use, upon manually depressing the locking member, the hood is pivotably mounted to the shroud so as to slide over the locking member and cover a lower portion of the shroud below the locking member.

* * * * *